United States Patent [19]

Blazek et al.

[11] 4,449,567

[45] May 22, 1984

[54] METHOD AND APPARATUS FOR USE IN CASTING AN ARTICLE

[75] Inventors: William S. Blazek, Valley City; Thomas S. Piwonka, Solon, both of Ohio

[73] Assignee: TRW Inc., Cleveland, Ohio

[21] Appl. No.: 63,860

[22] Filed: Aug. 6, 1979

[51] Int. Cl.[3] ..... B22D 33/04

[52] U.S. Cl. ..... 164/137; 29/434; 29/526 R; 164/339; 269/54.4; 269/54.5

[58] Field of Search ..... 164/4, 6, 7, 23–26, 164/27, 137, 339, 341; 249/155, 157; 269/48.1, 48.2, 309, 310, 41, 43, 54.5, 54.4, 297, 321 W, 303; 279/2 R, 1 L, 112; 29/434, 526 R; 425/175

[56] References Cited

U.S. PATENT DOCUMENTS

| | | | |
|---|---|---|---|
| 2,472,083 | 6/1949 | Bartholdy | 269/297 X |
| 2,787,814 | 4/1957 | Milligan | 164/339 |
| 4,009,874 | 3/1977 | Hughey | 269/54.5 X |
| 4,048,709 | 9/1977 | Deem | 164/4 |
| 4,066,116 | 1/1978 | Blazek et al. | 164/23 |
| 4,224,976 | 9/1980 | Blazek | 164/4 |

FOREIGN PATENT DOCUMENTS

| | | | |
|---|---|---|---|
| 562414 | 8/1958 | Canada | 269/297 |
| 904935 | 11/1945 | France | 279/112 |

*Primary Examiner*—Gus T. Hampilos
*Attorney, Agent, or Firm*—Yount & Tarolli

[57] ABSTRACT

A plurality of mold wall segments are positioned in a circular array in an adjustable fixture to form a mold assembly. The fixture includes a base with a plurality of upstanding pin members. Two of the pin members engage the bottom portion of each mold wall segment. Each pin member is eccentrically mounted on a disc. By rotating the discs relative to their base, the mold wall segments may be moved inward or outward. This movement varies the diameter of the lower portion of the mold assembly. The pin members have threaded end portions which enable the pin members to be moved along their upstanding central axes. This movement varies the height of the lower portion of the mold assembly. In addition, the fixture includes a plurality of radially extending adjusting rods, each rod engages a radially inner side surface of a mold segment. By moving the rods radially inward or outward, each mold wall segment is caused to tilt or rotate about an axis extending through the upper end portions of the pin members which engage the bottom portions of that mold wall segment. This movement varies the diameter of the upper portion of the mold assembly. In one embodiment of the invention, the mold segments of inner and outer annular arrays of mold segments are independently movable relative to each other.

25 Claims, 4 Drawing Figures

METHOD AND APPARATUS FOR USE IN CASTING AN ARTICLE

BACKGROUND OF THE INVENTION

The present invention relates to a method and apparatus for forming a mold which is used in casting an article and more specifically to a method and apparatus for positioning mold segments in a desired relationship to one another.

In a known method of forming a mold, mold wall segments are formed by repetitively dipping a wax or plastic pattern assembly in a ceramic slurry and subsequently melting out the pattern to leave a mold cavity. Once the mold wall segments are formed, they are joined to each other to form a complete mold assembly. A method of forming a mold in this manner is shown in U.S. Pat. No. 4,066,116.

In order to avoid deflection of the wax pattern during dipping, the pattern may be reinforced with a reusable, nondestructable pattern piece. A method of reinforcing a wax pattern is shown in U.S. Pat. No. 4,043,379.

When relatively large objects are to be cast with a mold similar to the one shown in U.S. Pat. No. 4,066,116, difficulty has been encountered in obtaining a cast product having the desired dimensions. This may be due to many causes, among which are shrinkage of the wax pattern before dipping, dimensional changes in the ceramic mold during drying and firing, and shrinkage of the casting material upon cooling.

The extent of shrinkage of the cast material is difficult to predict accurately. The amount of shrinkage in any portion of the article depends upon the rate of cooling of that particular portion. In turn the rate of cooling of a portion of a casting is dependent on such factors as the cross sectional area of that portion of the casting and its distance from areas of larger or smaller cross section. It may be possible to calculate the extent of shrinkage for some simple geometric shapes, but for large articles having an annular or tubular shape in which the cross section varies along the axis of the article, it is difficult to accurately predict the extent of shrinkage.

In an effort to provide relatively large and dimensionally accurate castings, a fixture assembly has been utilized to locate sections of a mold relative to each other. This known fixture assembly is constructed in the manner disclosed in U.S. Pat. No. 4,224,976. This application discloses a fixture having a plurality of upstanding pin members which are utilized to support a circular array of mold wall sections. The positions of the pin members can be varied to adjust the diameter of the circular array of mold wall sections.

Although the fixture disclosed in the aforementioned U.S. Pat. No. 4,224,976 is preferred to other known devices for use in assembling molds, difficulty may be encountered in using this fixture when a relatively large article having portions with different cross sectional configurations is to be cast. For example, when an annular article having different configurations along the axial extent of the article is to be cast, it may be desirable to adjust the diameters of opposite axial ends of the annular mold to different extents. With the device disclosed in U.S. Pat. No. 4,224,976 both axial ends of the mold are adjusted to the same extent when the positions of the upstanding pin members are changed.

A mold which is utilized to cast annular articles may have inner and outer arrays of mold wall segments which are interconnected in the manner disclosed in U.S. Pat. No. 4,066,116. When a mold is assembled of inner and outer arrays of mold wall segments, it may be desirable to move both the inner and outer mold wall segments relative to each other. In this situation, difficulty may also be encountered in using the apparatus disclosed in the aforementioned U.S. Pat. No. 4,224,976. Because the fixture disclosed in this application does not provide for movement of a mold wall segment in an annular outer array of mold wall segments relative to a mold wall segment in an annular inner array of mold wall segments.

SUMMARY OF THE INVENTION

The present invention provides a method and apparatus for adjusting a mold assembly to minimize dimensional inaccuracies in a cast article. In practicing the invention, a plurality of mold wall segments are positioned in an adjustable fixture. The mold wall segments are interconnected and removed from the fixture. A test casting is then made. The cast article is measured for dimensional accuracy.

The fixture is then adjusted to compensate for any inaccuracy in the cast article. A new set of mold wall segments, identical to the first ones, is installed in the fixture and second mold for a second casting is assembled. The second article cast will have different dimensions from the first article because the fixture held the second set of mold wall segments in a slightly different position from the first set. The test casting process may be repeated if necessary in order to obtain an article of exactly the desired size and shape. Once the support fixture is properly adjusted, any number of identical articles each having the desired dimensions may be cast using identical sets of mold segments.

The casting of a number of identical articles requires the use of a separate mold for each article cast. The mold wall segments used to form each successive mold are interchangeable. Therefore once the fixture has been properly adjusted, when a new set of mold segments is placed in the fixture, the size and shape of the mold cavity is the same as it was for the previous set of mold wall segments. To provide for the repetitive positioning of mold wall segments, sockets or slots are accurately located on the exterior of the mold wall segments. The sockets are engaged by the fixture to assure that each mold wall segment is supported in the proper position.

In one preferred embodiment of the invention the fixture includes a base having a plurality of upstanding pin members. The pin members are disposed in a circular array. The upper end portions of two pin members engage the bottom of each mold wall segment. Each pin member is mounted on an eccentric so that its position may be varied to adjust the position of the bottom of a mold wall segment. In addition, the pin members are axially movable to adjust the vertical position of a mold wall segment.

Also mounted on the base are a number of adjusting members. The adjusting members engage the sides of the mold wall segments. Thus each mold wall segment is supported by three members. Two pin members support the bottom of the mold wall segment, and one adjusting member supports the side of the mold wall segment.

Means are provided for moving the adjusting members to cause tilting or rotational movement of the mold wall segments about an axis passing through the upper end portions of the upstanding pin members which engage the bottom of each mold wall segment. This effects a change in the location of a side of the mold wall segment relative to the fixture base.

The method and apparatus of the present invention are particularly advantageous when a mold for a large annular article having varying wall thicknesses is to be fabricated. In such a case, a plurality of mold wall segments are arranged in a circular array on the upstanding pin members. The diameter of the bottom portion of the array of mold wall segments may be adjusted by rotating the eccentrics connected with the upstanding pin members. This causes translational movement of the mold wall segments relative to each other. If all of the pins are rotated, then all of the mold wall segments will move either inward or outward to change the diameter of a lower portion of the mold cavity.

In addition the diameter of the upper end portion of the mold cavity may be adjusted without changing the previously adjusted bottom diameter. This is done by varying the position of the adjusting members and/or by varying the axial position of one or more pin members.

Varying the position of the adjusting members rotates each mold wall segment about an axis which passes through the upper end portions of the pin members engaging the bottom of the mold wall segment. As each mold wall segment is rotated, the angular orientation of the mold segment relative to the base changes. This results in a change in the diameter of the upper portion of the circular array of mold wall segments.

Adjusting the axial position of one of the two upstanding pin members which support a mold wall segment, rotates the mold wall segment. This rotation occurs about an axis which passes through the outer end portion of an adjusting member to vary the angular orientation of the mold wall segment relative to the base. Of course, the height of each mold wall segment relative to adjacent mold wall segments can be varied by adjusting the axial positions of the pin members which support a mold wall segment.

When an annular article is to be cast from a mold having an annular inner array of mold wall segments and an annular outer array of mold wall segments, the positions of mold wall segments in either one of the two arrays can be adjusted relative to mold wall segments in the other array of mold wall segments. This is accomplished by providing adjusting devices in association with both the inner array of mold wall segments and the outer array of mold wall segments.

Accordingly, it is an object of the present invention to provide a new and improved method and apparatus wherein a plurality of mold wall segments are disposed in an array, a first device being provided to adjust a first dimension of the array of mold wall segments and a second device being provided to adjust a second dimension of the array of mold wall segments.

It is a further object of the present invention to provide a new and improved method and apparatus as set forth in the previous object and wherein the first device includes first and second members which engage a bottom portion of a mold wall segment and are mounted to adjust the position of the bottom portion of the mold wall segment, and the second device includes a third member which engages a side portion of a mold wall segment, the third member being movable to pivot a mold wall segment about an axis extending transversely to the first and second members to adjust the position of the side portion of the mold wall segment.

Another object of this invention is to provide a method and apparatus for use in casting an annular article and wherein the position of a mold wall segment in either an inner annular array of mold wall segments or an outer annular array of mold wall segments can be adjusted relative to the adjacent mold wall segments.

BRIEF DESCRIPTION OF THE DRAWINGS

These and objects and features of the present invention will be made clear to those skilled in the art to which it pertains upon reading the following description of preferred embodiments taken together with the accompanying drawings in which.

DESCRIPTION OF PREFERRED EMBODIMENTS

Figure 1:
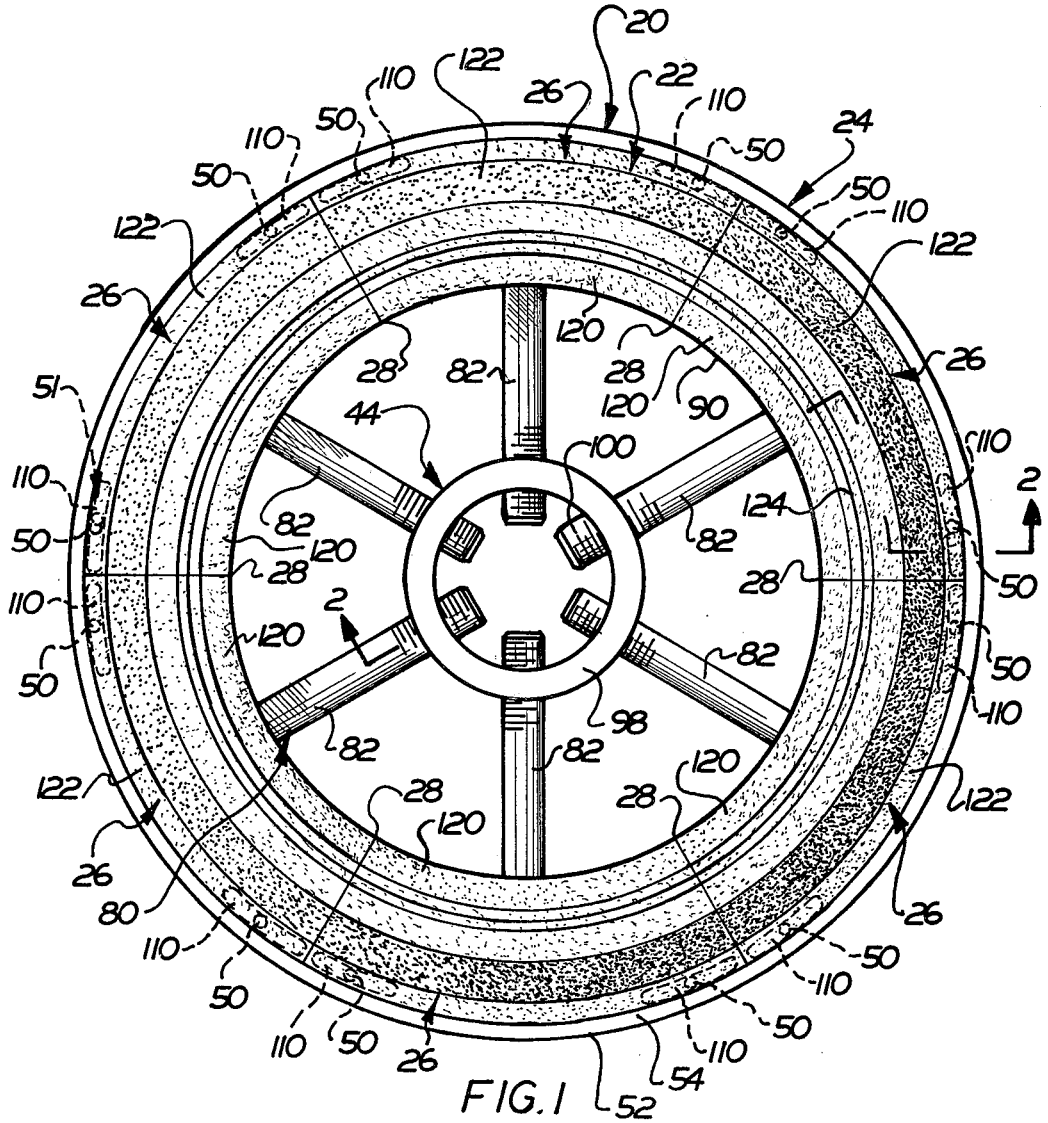
FIG. 1 is a plan view of an annular array of mold segments and a fixture constructed in accordance with the present invention.
Figure 2:
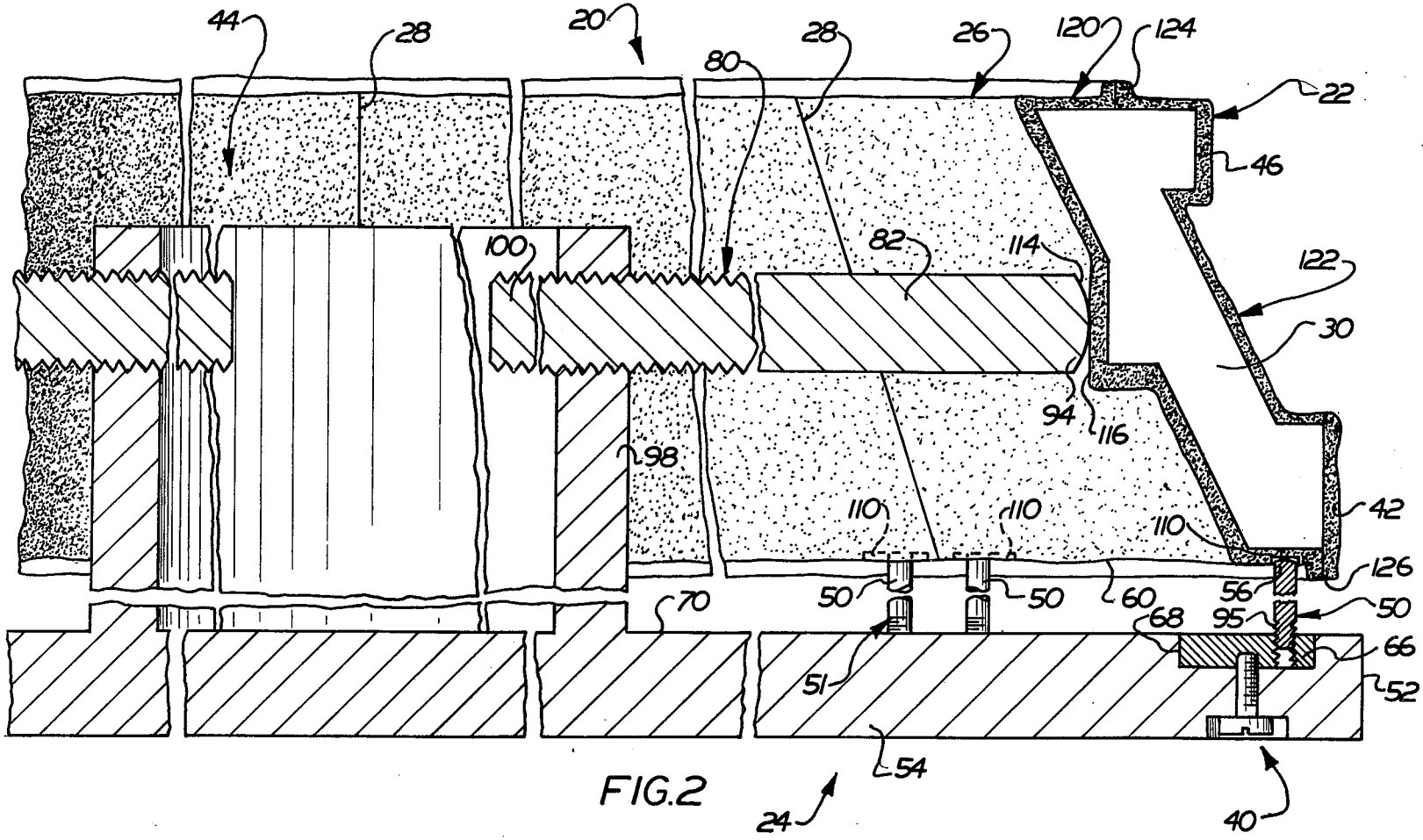
FIG. 2 is a sectional view, taken along line 2—2 of FIG. 1, illustrating a portion of the array of mold segments and the fixture which is used to position them.

An assembly 20 for use in casting an article is shown in FIGS. 1 and 2. A mold assembly 22 is disposed in a fixture 24. The mold assembly 22 comprises a plurality of arcuate mold segments 26 arranged in a circular array in the fixture 24. Each mold segment 26 is connected with the adjacent mold segments with the joints 28 between the mold segments are sealed to form an annular mold cavity 30.

The fixture 24 is adjustable to adjust the size of the mold cavity 30 and the article which is cast in the mold assembly 22. Thus, a first mold assembly 22 is assembled using the fixture 24. The mold assembly 22 is then removed from the fixture 24, and a sprue (not shown) is attached. One suitable sprue is illustrated in U.S. Pat. No. 4,066,116. The mold assembly 22 and sprue are subsequently packed in insulating material, and a first article is cast.

The first article is removed from the mold assembly 22 and is measured for dimensional accuracy. If the article varies from the desired predetermined dimensions, the fixture 24 is adjusted to change the positions in which the mold segments 26 are supported. Then a second mold assembly 22 composed of mold wall segments identical to the mold wall segments used to form the first mold assembly are placed in the fixture 24 and the joints between adjacent mold wall segments are cemented. The second mold assembly 22 is then removed from the fixture 24 and a second casting is made. The second article is measured for dimensional accuracy, and if required, the mold fixture 24 may be adjusted again. This process may be repeated until an article having the desired dimensions is produced.

Once the fixture 24 has been adjusted so that the mold assembly 22 is supported in the fixture 24 to form an article of the desired dimensions, any number of additional mold assemblies 22 may be assembled in the fixture 24, and each will produce an article of the desired dimensions. The manner in which the fixture 24 is repetitively used to obtain a casting of the desired dimensions is generally similar to the method disclosed in the aforementioned Blazek Application Ser. No. 869,219.

The mold assembly 22 and the fixture 24 are adapted for use in casting an article having a generally annular shape. However, this is by way of example only and is not intended to limit the scope of the present invention. It is contemplated that the present invention may be utilized in forming articles having a configuration different from an annular configuration.

The adjustable fixture 24 (FIG. 2) supports the mold assembly 22 while the segments 26 are assembled and interconnected. The fixture 24 includes an apparatus 40 for adjusting the diameter of the lower portion 42 of the mold assembly 22. The fixture 24 also includes an apparatus 44 for adjusting the diameter of the upper portion 46 of the mold assembly 22 while maintaining the diameter of the lower portion 42 substantially constant.

If it is discovered upon measuring a test casting that the diameter of the lower portion 42 of the mold assembly 22 was too small and that the diameter of the upper portion 46 of the mold assembly was also too small, then the apparatus 40 is adjusted to increase the diameter of the lower portion of the mold assembly. Also the apparatus 44 is adjusted to increase the diameter of the upper portion 46 of the mold assembly 22. A new mold assembly 22 is subsequently assembled on the fixture 24 and the joints 28 between the mold segments are cemented.

It may be that the test article produced in the mold assembly 22 has a lower diameter which is too large, and an upper diameter which is too small. In this event the apparatus 40 is adjusted to decrease the diameter of the lower portion 42 of the mold assembly 22, and the apparatus 44 is adjusted to provide the desired upper dimension of the article. Another casting is made and the resulting article is measured for conformity with the desired dimensions.

It is to be understood that the apparatuses 40 and 44 may be operated independently of each other so that the fixture 24 may accommodate deviations in the diameter of the upper portion 46 and the lower portion 42 of the mold assembly 22. Thus in addition to the above examples, the apparatuses 40 and 44 may be adjusted to compensate for a test casting in which both the upper and lower dimensions are too large or in which the lower dimension is too small and the upper is too large.

The apparatus 40 for adjusting the diameter of the lower portion 42 of the mold assembly 22 includes a plurality of upstanding pin members 50. The pin members 50 are disposed in a circular array 51 adjacent the cylindrical outside surface 52 of the fixture base 54. The array of upstanding pin members 50 is coaxial with the circular fixture base 54.

The array 51 of upstanding pin members 50 includes a pair of pin members for each mold segment 26. The upper end portion 56 of each cylindrical pin member 50 engages the bottom portion 60 of each mold segment 26 near the joints 28 between adjacent mold segments. The vertical pin members 50 support the mold assembly 22 above the horizontal fixture base 54 to provide access to a bottom portion 60 of the mold segments 26 in order to facilitate cementing the joints between adjacent mold segments.

The upstanding pin members 50 may be adjusted to vary the diameter of the lower portion 42 of the mold assembly 22. Each upstanding pin member 50 in an annular array 51 of pin members is individually adjustable. This provides flexibility in the positioning of each mold segment 26.

To provide for individual adjustment, each upstanding pin member 50 is eccentrically mounted on a disc 66. Therefore the upper end portion 56 of a pin member 50 sweeps a circular path as the disc 66 is rotated. The cylindrical disc 66 is rotatably received in a corresponding cyclindrical recess 68 which extends downwardly from the horizontal upper surface 70 of the fixture base 54. The vertical central axis of the cylindrical upstanding pin member is parallel to and offset from the central axis of the cylindrical disc 66. The disc 66 is rotatable about its central axis to adjust the location of the upper end portion 56 of the upstanding pin 50 relative to the other pins, the fixture base 54, and the center line of the mold assembly 22.

A locking screw 72 extends through the fixture base 54 and threadably engages the disc 66. Once the upstanding pin member 50 has been adjusted to a desired position, the locking screw 72 is tightened to hold the disc 66 against rotation, and thereby to hold the pin member in the position to which it has been adjusted.

All of the upstanding pin members 50 are adjustable in the same manner, and each is independently adjustable. The aforementioned U.S. patent application Ser. No. 869,219 discloses a similar method and apparatus for adjusting the position of a portion of a mold assembly.

The apparatus 44 (FIGS. 1 and 2) for adjusting the diameter of the upper portion 46 of the mold assembly 22 includes a circular array 80 of radially extending adjusting rods or members 82. The circular array 80 (Fig. 1) is coaxial with the fixture base 54 and the circular array 51 of upstanding pin members 50. The adjusting rods or members 82 are disposed parallel to and spaced above the horizontal upper surface 70 (FIG. 2) of the fixture base 54 and the upper end portions 56 of the upstanding pin members 50.

One adjusting rod 82 is provided for each mold segment 26 in the mold assembly 22. The adjusting rods 82 engage an inner side portion 90 of the mold segments 26. As can be seen in FIG. 2, the adjusting rods 82 engage the inner sides 90 of the mold segments 26 between the upper and lower portions of the mold assembly 22. As is best shown in FIG. 1, the adjusting rod 82 also engages the inner side 90 of the mold segment 26 at a location midway between the joints 28 and the pin members 50 which are disposed adjacent the joints.

There is thus provided a three point support for each mold segment 26 (FIG. 2). The upper end portions 56 of two upstanding pin members engage the bottom portion 60 of each mold segment 26. In addition, one adjusting rod 82 engages the inner side 90 of each mold segment 26.

Radial adjustment of the adjusting rods 82 (FIG. 1) is provided to adjust the diameter of the upper portion 46 (FIG. 2) of the mold assembly 22. Each adjusting rod is movable axially to adjust the position of a mold segment 26 in a radial direction. The adjusting rods 82 extend radially and are movable inward and outward to adjust the diameter of the upper portion 46 of the mold assembly 22.

When an adjusting rod 82 moves radially inward or outward, the associated mold segment 26 pivots or rotates about an axis extending through the upper end portions 56 of the pair of upstanding pin members 50 which engage the bottom portion 60 of the associated mold segment. The axis about which the mold segment 26 rotates when the adjusting rod 82 is moved forms a chord with the circular array 51 of upstanding pin members 50. The pivoting or rotation of the mold segment 26 upon axial movement of the adjusting rod 82 varies the angular orientation of a mold segment relative to the base 54 and adjacent mold segments. This is effective to vary the diameter of the upper portion 46 of the mold assembly 22 while the diameter of the lower portion 42 of the mold assembly remains substantially constant.

When the position of both pin members 50 which engage the bottom portion 60 of the same mold segment 26 are moved simultaneously, the lower portion 42 of the mold segment 26 moves radially inward or outward. As the lower portion 42 moves radially inward or outward, the mold segment 26 pivots about an axis extending through the outer end portion 94 of an adjusting rod 82. This axis is parallel to the axis extending through the upper end portions 56 of the upstanding pin members 50 and the fixture base 54 and forms a chord to the circular array 51 of upstanding pin members 50.

Moving the upstanding pin members 50 varies not only the diameter of the lower portion 42 of the mold assembly 22 but also the diameter of the upper portion 46 of the mold assembly. This is so because the axis about which the mold segment 26 rotates when both pin members 50 are moved is intermediate between the upper portion 46 and the lower portion 42 of the mold assembly 22. The adjusting rods 82 can be moved to compensate for movement of the upper portion 46 of the mold assembly 22. This enables the diameter of only the lower portion 42 of the mold assembly to be adjusted if desired.

The adjusting rods 82 could be located so that they engage the inner side 90 of the mold segment 26 at a location adjacent to the upper portion 46 of the mold assembly 22. In such a case moving the upstanding pins 50 would change only the diameter of the lower portion 42 of the mold assembly 22. The diameter of the upper portion 46 would remain substantially constant when the pin members 50 are moved.

The motion of the mold segment 26 caused by movement of the upstanding pin members 50 has been described as if the pin members 50 engaging the bottom portion 60 of each mold segment were moved simultaneously. Of course, it will be understood that in practice only one of the upstanding pin members 50 which engage the bottom portion 60 of mold segment 26 may be moved at a time. In the event that only one pin member 50 is moved, the mold segment 26 rotates about an axis extending through the upper end portion 56 of the pin member 50 which was not moved and the outer end portion 94 of the adjusting rod 82. If first one and then the other of a pair of upstanding pin members 50 which engage the bottom portion 60 of the mold segment 26 is moved, the resulting motion of the mold segment is the same as it would be if both pin members had been moved simultaneously.

It is also contemplated that it may be desirable to either raise or lower the bottom portion of a mold segment relative to an adjacent mold segment and the base 54 of the fixture 24. To provide for vertical movement of each of the pin members 50 along its upstanding central axis, a threaded end portion 95 of each pin member extends into a threaded opening formed in association with one of the discs 66. Upon rotation of a pin member 50 about its central axis, the pin member is either raised or lowered to effect corresponding movement of the bottom portion 60 of an associated mold segment 26.

If only one of the two pin members 50 which supports a mold segment is moved vertically, the mold segment is pivoted about an axis which extends through the upper end of the other pin member and the area of engagement of an adjusting rod 82 with the side of the mold segment. If both of the pin members 50 supporting the bottom portion 60 of a mold segment are moved upward through the same distance relative to the base 54 of the fixture, the bottom 60 of the mold section is moved vertically upwardly. Similarly, if the pin members 50 supporting a mold segment are turned into the openings in the associated discs 66, the lower end portion of the mold segment is lowered.

The apparatus 44 (FIG. 1) for adjusting the diameter of the upper portion 46 of the mold assembly 42, as previously described, includes a plurality of adjusting rods or members 82. The horizontal adjusting rods or members 82 are supported by a cylindrical support wall 98 which is fixedly attached and concentric with the fixture base 54. The inner end portion 100 (FIG. 2) of each adjusting rod 82 is threaded and engages a threaded opening in the support wall 98.

Upon rotation of an adjusting rod 82 about its longitudinal central axes, the thread connection between the adjusting rod and the wall 98 causes the adjusting rod to move radially outward or inward relative to the annular mold assembly 22. It should be understood that the specific mechanism for adjusting the radial postion of the adjusting rods 82, that is threaded connections with the wall 98 do not in and of themselves form a part of the present invention. Other methods of causing radial movement of the adjusting rods 82 could provided.

The upper end portions 56 of the support pins 50 engage oval slots or sockets 110 which are accurately formed in the bottom portion 60 of each of the mold segments. The slots 110 have a length which is several times greater than the diameter of the upper end portions of the pins 50. However, the width of the slots 110 is only slightly greater than the diameter of the upper end portions of the support pins 56 to enable the pins to accurately and repeatedly position mold wall segments 26. The upper end surface of each of the support pins 56 is slightly rounded to facilitate pivoting movement of the mold segments 26 relative to the upper end portions of the pins. This mounting arrangement enables the mold segment 26 to pivot about the axis extending through the upper end portions of the support pins when a radial adjusting rod 82 is rotated to either increase or decrease the diameter of the upper portion 46 of the mold assembly 22.

The outer end portions 94 of the radial adjusting rods 82 have arcuate end surfaces 114 which abut a flat vertical locating surface 116 accurately formed on the radially inner sides of the mold segments 26. Upon vertical adjustment of one of the support pins 50 at its threaded connection 95, the mold segment 26 is pivoted about an axis extending through the vertical surface 114 at the end of one of the adjusting rods 82.

If one of the support pins 50 and an adjusting rod 82 are both moved, only one corner of the mold segment 26 may be raised or lowered relative to the base 54 and the adjusting rod 82 without any pivoting of the mold segment. As this occurs, the position of the arcuate surface 114 and the outer end portion of the adjusting rod 82 relative to the support surface 116 changes slightly.

In the embodiment of the invention illustrated in Fig. 2, the mold segment 26 has an arcuate inner mold wall segment 120 which is supported on the pins 50 and is engaged by an adjusting rod 82. An arcuate outer mold wall segment 122 is connected with the inner mold wall segment 120 at flange joints 124 and 126 after the inner mold wall 120 has been accurately positioned relative to the base 54 by positioning the support pins 50 and adjusting rod 82 relative to the base. The manner in which the outer mold segment 122 is connected with the inner mold segment 120 is the same as is described in the aforementioned U.S. Pat. No. 4,224,976. However, it should be understood that the annular array of mold segments 26 is formed by a circular array of inner mold wall segments 120 to which a circular array of outer mold wall segments 122 is connected. If desired, the outer mold wall segments 122 could be disposed on the pin members 50.

Figure 4:
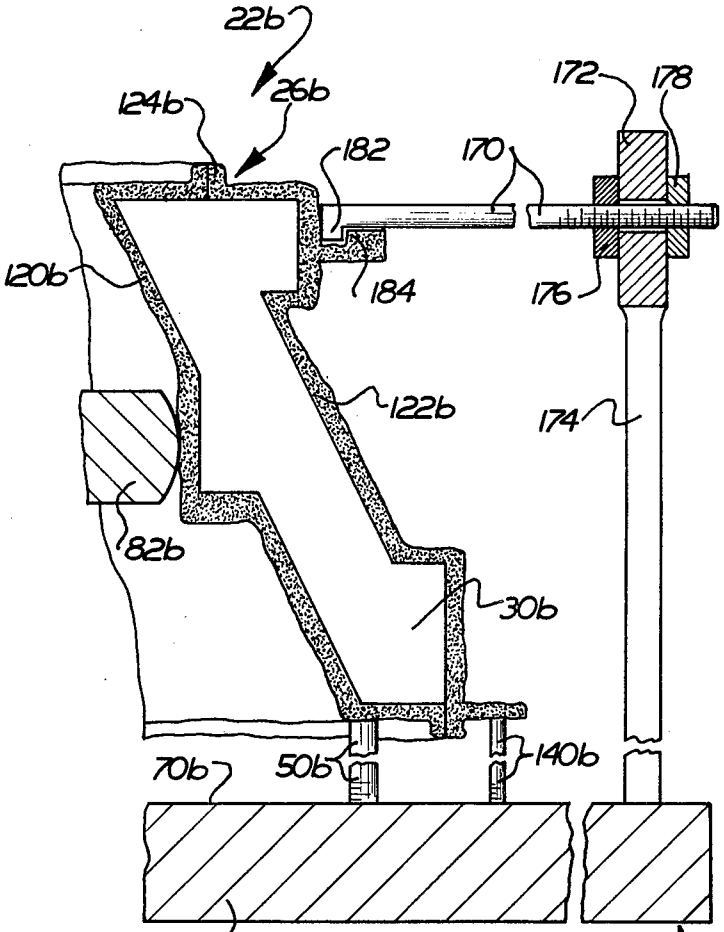
FIG. 4 is a fragmentary sectional view, similar to FIG. 3, of another embodiment of the invention.

In the embodiment of the invention illustrated in FIGS. 1 and 2, the inner mold wall segment 120 is supported on the vertical support pins 50 and the outer mold wall segment 122 is connected to the inner mold wall segment at flange joints 124 and 126. However, it is contemplated under certain circumstances it may be desirable to support both the radially inner mold segment 120 and the radially outer mold segment 122 in such a manner the positions of the inner and outer segments 120 and 122 can be adjusted relative to each other. Accordingly, in the embodiment of the invention illustrated in FIGS. 3 and 4, the outer mold wall segment is supported separately from the inner mold wall segment. Since the embodiments of the invention illustrated in FIGS. 3 and 4 are generally similar to the embodiment of the invention illustrated in FIGS. 1 and 2, similar numerals will be utilized to designate similar components, the suffix letter "a" being associated with the numerals designating elements of FIG. 3 and the suffix letter "b" being associated with the numerals designating elements of FIG. 4 in order to avoid confusion.

Figure 3:
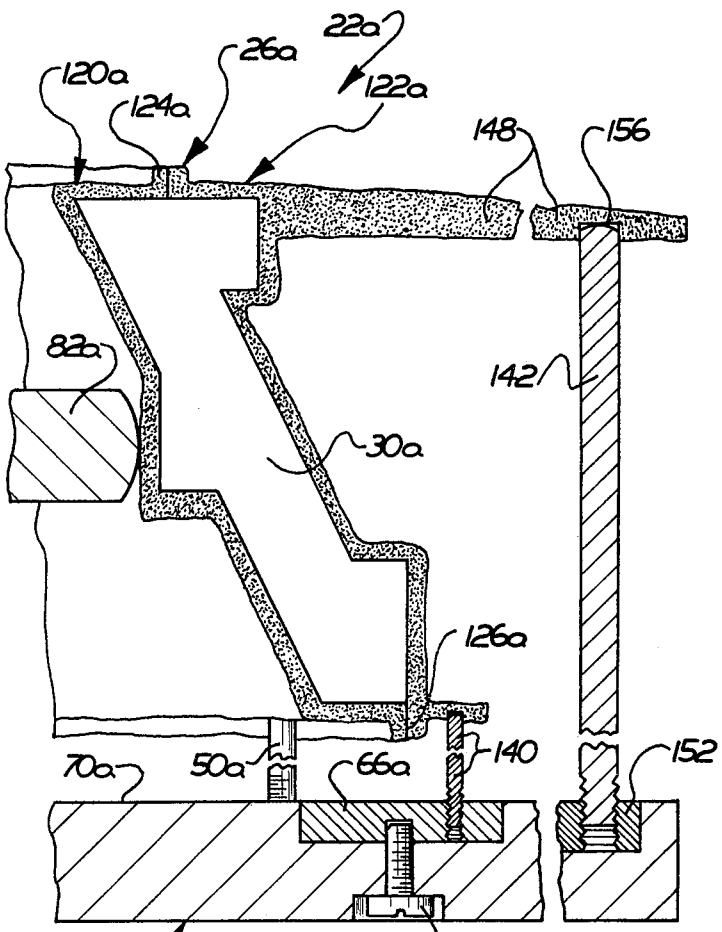
FIG. 3 is a fragmentary sectional view, similar to FIG. 2, of an embodiment of the invention in which inner and outer mold wall segments are adjustable relative to each other.

In the embodiment of the invention shown in FIG. 3, the inner mold wall segment **120*a* is supported on the upper end portions of a plurality of vertical support pins 50*a* which are adjustable relative to a base 54*a* of a fixture 24*a*. Although only a single inner mold wall segment 120*a* is shown in FIG. 3, it should be understood that the mold wall segment 120*a* forms but one part of a circular array of inner mold wall segments 120*a* which are supported by a circular array of support pins 50*a* extending upwardly from the base 54*a* in the same manner as in which the circular array of inner mold wall segments 120 are supported by the pins 50 in the embodiment of the invention illustrated in FIGS. 1 and 2**.

The support pins **50*a* supporting the mold wall section 120*a* of FIG. 3 and a rod 82*a* are adjustable to adjust the position of the inner mold wall segment 120*a*. This is accomplished in the same manner as previously explained in connection with the embodiment illustrated in FIGS. 1 and 2**.

Once the position of the inner mold wall segment **120*a* has been adjusted, the outer mold wall segment 122*a* is mounted on a plurality of vertical support pins 140 and 142. The outer mold wall segment 122*a* is supported by the pins 140 and 142. The outer segment 122*a* abuts the inner segment 120*a* at flange joints 124*a* and 126*a* to define a portion of the annular mold cavity. Although only a single support pin 140 has been shown in FIG. 3, there is a circular array of support pins 140 with two support pins for each mold wall segment 122*a*. Similarly, there is a circular array of support pins 142 which is coaxial with the circular arrays of support pins 140 and 50*a***.

The support pins 140 and 142 are adjustable vertically and horizontally to position the outer mold wall segment **122*a* in the same manner as previously described in connection with the pins 50 of the embodiment of the invention shown in FIGS. 1 and 2. Thus, the upstanding support pin 140 is eccentrically mounted on a rotatable cylindrical disc 66*a*. Since the support pin 140 is offset from the vertical central axis of the disc 66*a*, upon rotation of the disc 66*a* the upper end portion of the support pin 140 sweeps a circular path. This movement of the upper end of the support pin 140 moves the bottom of the mold segment 122*a* relative to the base 54*a*. As this occurs, the position of the pin 140 relative to an oval recess in the bottom of the mold wall segment 122*a*** changes.

The cylindrical disc **66*a* is rotatably received in a corresponding cylindrical recess which extends downwardly from the upper surface 70*a* of the fixture base 54*a*. The vertical central axis of the upstanding cylindrical pin member 140 is parallel to and offset from the central axis of the cylindrical disc 66*a*. The cylindrical disc 66*a* is rotatable about its central axis to adjust the location of the upper end portion of the pin member 140 relative to the second pin member 142 which supports the outer mold wall 122*a* of the mold segment 26*a*. In addition, the pin 140 extends parallel to pins 50*a* which support the inner mold wall 120*a***.

A locking screw **72*a* extends through the fixture base 54*a* and threadably engages the disc 66*a*. Once the upstanding pin member 140 has been adjusted to a desired position, the locking screw 72*a* is tightened to hold the disc against rotation and thereby to hold the pin member in the position to which it has been adjusted. Although only a single pin member 140 has been shown in FIG. 3, it should be understood that a pair of pin members 140 are utilized to support the outer wall 122*a* of the mold segment 26*a* in the same manner as in which a pair of pin members 50 are used to support the inner wall 120 of the mold segment 26 of the embodiment of the invention illustrated in FIGS. 1 and 2**.

The mold assembly **22*a* of FIG. 3 includes an annular array of inner mold walls 120*a* which are supported by an annular array of pin members 50*a* and an annular array of outer mold walls 122*a* which are supported by an annular array of pin members 140. The annular array of pin members 140 is coaxial with and circumscribes the annular array of pin members 50*a*. Since the pin members 50*a* and 140 are independently adjustable in both a vertical and horizontal direction, the lower end portions of both the inner mold wall 120*a* and the outer mold wall 122*a*** can be independently adjusted relative to each other to accurately define a mold cavity having a desired size.

The upper end portion of each outer mold wall segment **122*a* is supported by a vertical pin 142. The upper end portion of the pin 142 engages an oval slot in an extension 148 which projects radially outwardly from the upper end portion of the outer mold wall 122*a*. The extension 148 can be formed separately from the outer mold wall 122*a*** and attached thereto or can be integrally formed with the mold wall if desired.

The support pin 142 is vertically and horizontally adjustable in the same manner as are the support pins 50*a* and 140. Thus, the support pin 142 has a threaded lower end portion which extends into the threaded opening in a cylindrical disc 152 having a central axis which is offset from the central axis of the vertical support pin 142. Upon rotation of the disc 152, the eccentric mounting of the support pin 142 relative to the disc 152 results in the upper end portion of the support pin sweeping through a circle in a manner previously described in connection with the support pins 50 of FIGS. 1 and 2. A suitable locking screw (not shown) is provided in association with the disc 152 to hold it once the position of the support 142 has been adjusted.

The upper end portion of the support pin 142 extends into an oval slot or socket 156 formed in the extension 148. Therefore, upon rotational movement of the eccentric cylinder 152, the upper end portion of the support pin 142 is effective to either pull the extension 148 radially outwardly or to push the extension radially inwardly. This movement of the extension 148 is effective to adjust the position of the upper portion of the mold wall segment 122*a* relative to the bottom portion of the mold wall segment.

When the extension 148 is pulled outwardly by the pin 142, the diameter of the upper portion of the mold cavity is increased by pivoting the mold wall 122*a* outwardly. This pivotal movement occurs about a horizontal axis extending through the upper end portions of a pair of support pins 140. When the extension 148 is pushed inwardly, the diameter of the upper end portion of the mold cavity is decreased by pivoting the mold wall 122*a* inwardly about the horizontal axis extending through the upper end portions of the support pins 140.

If the outer mold wall segment 122*a* is to be raised or lowered relative to the inner mold wall segment 120*a*, the vertical positions of the support pins 140 and 142 are adjusted. This is accomplished by rotating the support pins so that the threaded connections between the lower end portions of the support pins 140 and 142 and the associated eccentric discs are effective to move the support pins vertically relative to the base 54*a*. Although only a single support pin 142 is associated with a projection 148 which extends outwardly from a circumferentially central portion of the outer mold wall segment 122*a*, it is contemplated that a pair of support pins 142 could be provided if desired.

In the embodiment of the invention shown in FIG. 3, there are five cylindrical adjusting discs associated with the inner and outer mold wall segments 120*a* and 122*a*. Thus, a pair of cylindrical adjusting discs are associated with the support pins 50*a*, a second pair of cylindrical adjusting discs associated with a pair of support pins 140 and still another adjusting disc is associated with the support pin 142. In order to prevent interference between the various adjusting discs, they are offset circumferentially around the circular base 54*a*. However, the adjusting discs for the support pins 50*a* and 140 are located adjacent to edge portions of the mold wall segments 120*a* 122*a* in the same manner as are the support pins 50 of the embodiment of the invention shown in FIGS. 1 and 2. The outer support pin 142 is located adjacent to the central portion of the mold wall segment 122*a* in the same manner as in which the adjusting rod 82*a* is located adjacent to the central portion of the mold wall 120*a*.

In the embodiment of the invention illustrated in FIG. 4, the upper end portion of the outer mold wall segment 122*b* is engaged by a horizontal adjusting rod 170 which extends outwardly from a circular wall 172 which is coaxial with the circular base 54*b* of the fixture 24*b*. The circular wall 172 is supported above the base on legs or support sections 174. Upon loosening of lock nuts 176 and 178, the adjusting rod 170 can be moved radially inwardly or outwardly relative to the base 54*b*.

The adjusting rod 170 has a downwardly turned end portion 182 which extends into an accurately recess formed in an extension 184 on the upper end portion of the mold wall segment 122*b*. When the adjusting rod 170 is moved radially outwardly, that is toward the right as viewed in FIG. 4, the upper end portion of the mold wall segment 122*b* is moved outwardly away from the mold wall segment 120*b*. As this occurs, the lower portion of the mold wall 122*b* is pivoted about an axis extending through the upper end portion of a pair of support pins 140*b* in the manner previously described in connection with the embodiment of the invention shown in FIG. 3. Of course, when the support rod 170 is moved toward the left (as viewed in FIG. 2) the outer mold wall segment 122*b* is pivoted toward the inner mold wall segment 120*b*.

In view of the foregoing description, it is apparent that the present invention provides a method and apparatus to adjust mold assemblies 22, 22*a* and 22*b* to minimize dimensional inaccuracies in an article cast in an annular cavity formed by the mold assemblies. In practicing the invention, a plurality of mold segments 26 are assembled on an adjustable fixture, 24, 24*a* or 24*b*. The mold segments are interconnected and removed from the fixture. A test casting is then made. The cast article is measured for dimensional accuracy.

The fixture 24, 24*a* or 24*b* is then adjusted to compensate for any inaccuracy in the cast article. A new set of mold segments, identical to the first one, is assembled in the fixture and a second mold for a second casting is assembled. The second cast article will have different dimensions from the first cast article because the fixture held the second set of mold segments in a slightly different position from the first set of mold segments. The test casting process may be repeated if necessary in order to obtain an article of exactly the desired size and shape. Once the support fixture 24, 24*a* or 24*b* has been properly adjusted, any number of identical articles having the same desired dimensions may be cast using identical sets of mold segments.

The casting of a number of identical articles requires the use of a separate mold assembly 22, 22*a* or 22*b* for each article cast. The mold segments 26, 26*a* or 26*b* used to form successive molds are interchangeable. Therefore, once the fixture 24, 24*a* or 24*b* has been properly adjusted, when a new set of mold segments is placed in the fixture, the size and shape of the mold cavity is the same as it was for the previous set of mold segments. To provide for the repetitive positioning of mold segments, sockets or suitable openings are formed in the exterior of the mold segments. The sockets or openings are engaged by the fixture to assure that each mold segment is supported in a proper position.

In preferred embodiments of the invention, the fixture includes a base 54, 54*a* or 54*b* having a plurality of upstanding pin members 50, 50*a* or 50*b*. The pin members 50, 50*a* or 50*b* are disposed in a circular array. The upper end portions of the pin members engage the bottom of each mold segment 26, 26*a* or 26*b*. Each pin member 50, 50*a*, or 50*b* is mounted on an eccentric so that its position may be varied to adjust the position of the bottom of the mold segment. In addition, each of the pin members 50, 50*a*, or 50*b* is axially movable to adjust the position of the top of the mold segment.

Also mounted on the base are a number of adjusting members. The adjusting members engage the sides of the mold segments. Thus, the adjusting members 82, 82*a* and 82*b* engage the inner side of the inner mold segments 26, 26*a* and 26*b*. In the embodiments of the invention illustrated in FIGS. 3 and 4, adjusting members 142 and 170 engage the outer mold walls 122*a* and 122*b*. In addition, the outer mold walls 122*a* and 122*b* are supported by pin members 140*a* and 140*b*.

In the adjusting members 82, 82*a*, 82*b*, 142 and 170, are adjustable to cause tilting or rotational movement of the mold segments about an axis passing through the upper end portions of upstanding pin members which engage the bottom of each mold segment. This effects a change in the location of a side of the mold segment relative to a fixture base 54, 54*a* or 54*b*.

The method and apparatus for the present invention are particularly advantageous when a mold or large annular article having a varying wall thickness is to be fabricated. In such a case, a plurality of mold segments 26, 26*a* or 26*b* are arranged in a circular array on the upstanding pin members 50, 50*a* and 140, or 50*b* and 140*b*. The diameter of the bottom portion of the array of mold segments 26, 26*a* or 26*b* may be adjusted by rotating eccentrics connected with the upstanding pin members 50, 50*a* and 140, or 50*b* and 140*b*. If all of the pins supporting a mold assembly 22, 22*a* or 22*b* are rotated, then all of the mold segments 26, 26*a* or 26*b* will move either inward or outward to change the diameter of a lower portion of the mold cavity.

In addition, the diameter of the upper end portion of a mold cavity may be adjusted without changing the previously adjusted bottom diameter. This is done by varying the position of the adjusting members 82, 82*a* and 142, or 82*b* and 170. In addition, the diameter of the upper end portion of the mold cavity may be adjusted without changing the previously adjusted diameter by varying the axial position of one or more of the pin members 50, 50*a*, 140 or 140*b* which engage the lower porton of the mold segments 26, 26*a* or 26*b*.

What is claimed is:

1. A method of assembling a mold which is utilized to cast an article, said method comprising the steps of positioning a plurality of mold wall segments in an array having circular upper and lower end portions, changing the diameter of the lower end portion of the array of mold wall segments relative to the diameter of the upper end portion of the array of mold wall segments by moving lower end portions of the mold wall segments relative to upper end portions of the mold wall segments, and changing the diameter of the upper end portion of the array of mold wall segments relative to the diameter of the lower end portion of the array of mold wall segments by moving the upper end portions of the mold wall segments relative to the lower end portions of the mold wall segments.

2. A method as set forth in claim 1 wherein said step of changing the diameter of the upper end portion of the array of mold wall segments includes the step of changing the angular orientation of each of the mold wall segments relative to the central axis of the circular upper end portion of the array of mold wall segments.

3. A method as set forth in claim 2 wherein said step of changing the angular orientation of each of the mold wall segments includes the step of pivoting the mold wall segments about axes which are chords to the circular lower end portion of the array of mold wall segments.

4. A method of assembling a plurality of molds to cast articles having circular end portions, said method comprising the steps of providing an adjustable mold fixture which is adapted to receive a plurality of mold wall segments disposed in a circular array, said step of providing an adjustable mold fixture including the step of providing a first circular array of locating surfaces which are movable relative to each other to change the diameter of the first circular array of locating surfaces and providing a second circular array of locating surfaces disposed above the first circular array of locating surfaces, said locating surfaces of said second circular array being movable relative to each other to change the diameter of the second circular array of locating surfaces, said method further including the steps of providing a plurality of mold wall segments each of which has a mold surface area for defining a mold cavity, placing a first plurality of the mold wall segments in the fixture in a first circular array having circular upper and lower end portions, said step of placing a first plurality of mold wall segments in the fixture including positioning the first plurality of mold wall segments with the first circular array of locating surfaces engaging the lower end portion of the first circular array of mold wall segments and the second circular array of locating surfaces engaging the first circular array of mold wall segments at locations above the lower end portion of the first circular array of mold wall segments, interconnecting the first plurality of mold wall segments with the diameter of the upper end portion of the first circular array of mold wall segments differing from the diameter of the lower end portion of the first circular array of mold wall segments by a first amount, said step of interconnecting the first plurality of mold wall segments being performed with the mold surface areas on the first plurality of mold wall segments extending at a first angle relative to the central axis of the first circular array of mold wall segments, removing the first plurality of mold wall segments from the fixture after performing said step of interconnecting the first plurality of mold wall segments, casting a first one of the articles using the first plurality of mold wall segments, measuring the diameter of the circular end portions of the first article to determine the extent to which the diameters of the end portions of the first article deviate from predetermined diameters, changing the relationship between the diameters of the first and second circular arrays of locating surfaces to compensate for deviations in the diameters of the end portions of the first article from predetermined diameters, placing a second plurality of mold wall segments in the fixture in a second circular array having circular upper and lower end portions, said step of placing a second plurality of mold wall segments in the fixture including positioning the second plurality of mold wall segments with the first circular array of locating surfaces engaging the lower end portion of the second circular array of mold wall segments and the second circular array of locating surfaces engaging the second circular array of mold wall segments at locations above the lower end portion of the second circular array of mold wall segments, interconnecting the second plurality of mold wall segments with the diameter of the upper end portion of the second circular array of mold wall segments differing from the diameter of the lower end portion of the second circular array of mold wall segments by a second amount which differs from the first amount by an extent which is a function of the extent of deviation of the diameters of the first article from the predetermined diameters, said step of interconnecting the second plurality of mold wall segments being performed with the mold surface areas on the second plurality of mold wall segments extending at second angle relative to the central axis of the second circular array of mold wall segments and with the second angle differing from the first angle by an amount which is a function of the extent of deviation of the diameters of the first article from the predetermined diameters, removing the second plurality of mold wall segments from the fixture after performing said step of interconnecting the second plurality of mold wall segments, and casting a second one of the articles using the second plurality of mold wall segments.

5. A method as set forth in claim 4 wherein said step of changing the relationship between the diameters of the first and second circular array of locating surfaces includes the step of moving the locating surfaces of the second circular array radially relative to the locating surfaces of the first circular array.

6. An assembly comprising a base, a plurality of mold wall segments disposed in an array having circular upper and lower end portions and at least partially defining a mold cavity, first means engaging lower end portions of said mold wall segments for changing the diameter of the lower end portion of the array of mold wall segments relative to the diameter of the upper end portion of the array of mold wall segments, said first means including a circular array of pairs of members each of which is connected with said base and is disposed in engagement with a lower end portion of one of said mold wall segments, each of said pairs of members including a first member connected with said base and having an upper end portion which engages the lower end portion of the one mold wall segment at a first location and a second member connected with said base and having an upper end portion which engages the lower end portion of the one mold wall segment at a second location which is spaced from the first location, said first and second members being movable relative to said base to adjust the position of the lower end portion of the one mold wall segment relative to said base and the upper end portion of said one mold wall segment, and second means engaging said mold wall segments at locations above the lower end portions of said mold wall segments and above the upper end portions of said first and second members for changing the diameter of the upper end portion of the array of mold wall segments relative to the diameter of the lower end portion of the array of mold wall segments, said second means including a circular array of third members which is connected with said base and disposed in a coaxial relationship with the circular array of pairs of members, each of said third members being movable relative to said base to pivot one of said mold wall segments about an axis extending through the upper end portions of one of said first members and one of said second members to thereby change the position of the upper end portion of the one mold wall segment relative to said base and the lower end portion of the one mold wall segment.

7. An assembly as set forth in claim 6 wherein said third members are disposed within the circular array of mold wall segments, said third members having an elongated configuration with central longitudinal axes extending in a radial direction relative to the circular array of mold wall segments.

8. An assembly as set forth in claim 6 wherein said third members are disposed outside of the circular array of mold wall segments, said third members having an elongated configuration with central longitudinal axes extending in a radial direction relative to the circular array of mold wall segments.

9. An assembly as set forth in claim 6 further including means for raising and lowering said first and second members relative to said base to move said mold wall segments away from and toward said base.

10. An assembly as set forth in claim 6 wherein each of said third members has surface means for engaging a side surface area disposed on one of said mold wall segments and facing toward the center of the array of mold wall segments.

11. An assembly as set forth in claim 6 wherein each of said third members has an elongated configuration, said second means including means for moving said third members along their central axes to pivot said mold wall segments about the axes extending through the upper end portions of said first and second members.

12. An assembly as set forth in claim 6 wherein said mold wall segments include surface means for defining recesses in the lower end portion of said mold wall segments, said first and seclnd members being upstanding pin members having upper end portions disposed in said recesses, said first means further including means for changing the positions of said upstanding pins relative to said base and to said third members to change the angular orientation of said mold wall segments relative to said base.

13. An assembly as set forth in claim 12 further including means for effecting axial movement of said upstanding pin members relative to said base to vary the distance between the upper end portions of said upstanding pin members and said base.

14. An assembly as set forth in claim 13 wherein said third members are adjusting rods which are disposed in a circular array and have longitudinal central axes which extend radially relative to the circular array, each of said adjusting rods having an outer end portion which engages a mold wall segment at a location above the upper portions of said upstanding pin members.

15. An assembly as set forth in claim 14 wherein each of said adjusting rods is disposed outside of the array of mold wall segments.

16. An assembly as set forth in claim 6 wherein said third members are disposed within the array of mold wall segments and are movable radially relative to the circular array of pairs of members to pivot said mold wall segments relative to each other and relative to said base.

17. An assembly as set forth in claim 16 wherein said mold wall segments include locating surfaces disposed above the lower end portions of said mold wall segments and facing inwardly toward the center of the array of mold wall segments, said third members being disposed in abutting engagement with said locating surfaces.

18. An assembly as set forth in claim 1 wherein said first and second members are pin members having upwardly extending longitudinal central axes, said third members being rod members having central axes which extend transversely to the axes of said pin members.

19. An assembly as set forth in claim 18 wherein said rod members are disposed in a circular array and have inner end portions which engage said mold wall segments at a central portion of the circular array of rod members, said second means further including support means engaging outer end portions of said rod members at a radially outer portion of the circular array of rod members for supporting said rod members above said base.

20. An assembly as set forth in claim 18 wherein said rod members are disposed in a circular array and have outer end portions which engage said mold wall segments at a radially outer portion of the circular array of rod members, said second means further including support means engaging inner end portions of said rod members at a central portion of the circular array of rod members for supporting said rod members above said base.

21. An assembly for use in association with a plurality of mold wall segments disposed in a circular array and cooperating with each other to partially define an annular mold cavity having a configuration corresponding to the configuration of an article to be cast, each of said mold wall segments having side and bottom portions, said assembly comprising a base, first positioning members connected with said base and disposed in a first circular array, each of said first positioning members having surface means for engaging the bottom portion of one of the mold wall segments, first adjusting means for changing the positions of said first positioning members relative to said base to thereby vary the relative positions of mold wall segments engaged by said first positioning members and the diameter of said first circular array of positioning members, second positioning members connected with said base and disposed in a second circular array which is coaxial with and disposed above said first circular array, each of said second positioning members having surface means for engaging the side portion of a mold wall segment at a location above the bottom portion of the engaged mold wall segment, and second adjusting means for changing the positions of said second positioning members radially relative to said base to thereby vary the relative positions of mold wall segments engaged by said second positioning members and the diameter of said second circular array of positioning members.

22. An assembly as set forth in claim 21 wherein said first circular array of positioning members is larger than said second circular array of positioning members, said second circular array of positioning members being disposed on said base to engage inner side portions of a circular array of mold wall segments.

23. An assembly as set forth in claim 21 wherein said first circular array of positioning members is smaller than said second circular array of positioning members, said second circular array of positioning members being disposed on said base to engage outer side portions of a circular array of mold wall segments.

24. An assembly as set forth in claim 21 wherein each of said second positioning members has an elongated configuration and is movable along its longitudinal central axis in a radial direction relative to said first circular array of positioning members.

25. An assembly comprising a base, plurality of mold wall segments disposed in an array having circular upper and lower end portions and at least partially defining a mold cavity, first means engaging lower end portions of said mold wall segments for changing the diameter of the lower end portion of the array of mold wall segments relative to the diameter of the upper end portion of the array of mold wall segments, said first means including a circular array of pairs of members each of which is connected with said base and is disposed in engagement with a lower end portion of one of said mold wall segments, each of said pairs of members including a first member connected with said base and having an upper end portion which engages the lower end portion of the one mold wall segment at a first location and a second member connected with said base and having an upper end portion which engages the lower end portion of the one mold wall segment at a second location which is spaced from the first location, said first and second members being movable relative to said base to adjust the position of the lower end portion of the one mold wall segment relative to said base and the upper end portion of said one mold wall segment, and second means engaging said mold wall segments at locations above the lower end portions of said mold wall segments and above the upper end portions of said first and second members for changing the diameter of the upper end portion of the array of mold wall segments relative to the diameter of the lower end portion of the array of mold wall segments, said second means including a circular array of third members which is connected with said base and disposed in a coaxial relationship with the circular array of pairs of members, each of said third members being movable relative to said base to pivot one of said mold wall segments about an axis extending through the upper end portions of one of said first members and one of said second members to thereby change the position of the upper end portion of the one mold wall segment relative to said base and the lower end portion of the one mold wall segment, said mold wall segments including surface means for defining recesses in the lower end portion of said mold wall segments, said first and second members being upstanding pin members having upper end portions disposed in said recesses, said first means further including means for changing the positions of said upstanding pins relative to said base and to said third members to change the angular orientation of said mold wall segments relative to said base, said assembly further including means for effecting axial movement of said upstanding pin members relative to said base to vary the distance between the upper end portions of said upstanding pin members and said base, said third members being adjusting rods which are disposed in a circular array and have longitudinal central axes which extend radially relative to the circular array, each of said adjusting rods having an outer end portion which engages a mold wall segment at a location above the upper portions of said upstanding pin members, said second means further including a support wall which is circumscribed by said mold wall segments, each of said adjusting rods being mounted on said support wall.

* * * * *

UNITED STATES PATENT AND TRADEMARK OFFICE

CERTIFICATE OF CORRECTION

PATENT NO. : 4,449,567

DATED : May 22, 1984

INVENTOR(S) : William S. Blazek and Thomas S. Piwonka

It is certified that error appears in the above-identified patent and that said Letters Patent are hereby corrected as shown below:

Column 16, line 27, change "seclnd" to - - second - -.

Signed and Sealed this

*Twenty-third* Day of *October 1984*

[SEAL]

*Attest:*

GERALD J. MOSSINGHOFF

*Attesting Officer*

*Commissioner of Patents and Trademarks*